US005634759A

United States Patent [19]

Jenvey

[11] Patent Number: 5,634,759

[45] Date of Patent: Jun. 3, 1997

[54] RAISING AND LOWERING COLUMNS

[75] Inventor: Alan J. Jenvey, Notis, United Kingdom

[73] Assignee: Abacus Holdings Limited, United Kingdom

[21] Appl. No.: 535,020

[22] PCT Filed: Mar. 28, 1994

[86] PCT No.: PCT/GB94/00645

§ 371 Date: Dec. 19, 1995

§ 102(e) Date: Dec. 19, 1995

[87] PCT Pub. No.: WO94/23161

PCT Pub. Date: Oct. 13, 1994

[30] Foreign Application Priority Data

Apr. 6, 1993 [GB] United Kingdom ..... 9307210
Jun. 29, 1993 [GB] United Kingdom ..... 9313399

[51] Int. Cl.[6] ..... B66F 11/00

[52] U.S. Cl. ..... 414/23; 52/117

[58] Field of Search ..... 414/23; 52/115, 52/116, 117, 118, 119, DIG. 11; 248/159

[56] References Cited

U.S. PATENT DOCUMENTS 3,161,301 12/1964 Versch .
3,292,320 12/1966 Laharty ..... 414/23
3,355,847 12/1967 Pratt ..... 52/116
3,362,116 1/1968 Erickson et al. ..... 52/116
4,020,606 5/1977 Pratt .
5,168,680 12/1992 Matlock ..... 52/117
5,426,444 6/1995 Sauter et al. ..... 52/118

FOREIGN PATENT DOCUMENTS 2609737 7/1988 France .
717317 4/1942 Germany .
1901659 8/1970 Germany .
2319877 11/1973 Germany .
3202836 8/1983 Germany .
4205487 7/1993 Germany .

*Primary Examiner*—Karen B. Merritt
*Assistant Examiner*—Douglas Hess
*Attorney, Agent, or Firm*—Young & Basile, P.C.

[57] ABSTRACT

An upper part 30 of a column 28 can be raised and lowered by ram 11 which is normally carried by a counterbalance unit but which can be attached to the column. The rams 11 are mounted on a chassis 10 of the unit by disengageable pivotal mounts 22/23 and are normally carried in a storage position (FIG. 2). To mount the rams on the column, they are first swung about the pivotal mounts, and are then extended to bring bosses 19 into engagement with gussets 32 on the upper column part 30. Thereafter, the rams are retracted to lift them out of their pivotal mounts 22/23, and are swung about the bosses 19 to bring them into engagement with further gussets 31 on a base part 29 of the column.

11 Claims, 4 Drawing Sheets

RAISING AND LOWERING COLUMNS

BACKGROUND OF THE INVENTION

This invention relates generally to raising and lowering columns, ie columns which comprise a relatively fixed base part and an upper part which can be raised and lowered relative to the base part. More particularly, the invention concerns apparatus for raising and lowering the columns, and a method of attaching the apparatus to the columns.

Operation of raising and lowering columns is generally performed by one or more piston and cylinder devices which is/are secured to respective attachment points on the two column parts. In locations where a large number of such columns are fitted, it is expensive to provide each column with its own individual piston and cylinder device(s). Instead, a so called counterbalance unit is employed, which is moved from column to column and on which the piston and cylinder device(s) are mounted for detachable securement to whichever column needs to be serviced/repaired. Such securement is often performed by manual lifting of the piston and cylinder device(s) into position on the column. This can be a hazardous operation, particularly where tall columns are concerned and the piston and cylinder device(s) are large and therefore heavy.

DE-A-1901659 discloses one example of such a counterbalance unit, wherein the piston and cylinder device is carried on a wheeled support. Although the support does assist in the maneuvering of the piston and cylinder into position, there is still a danger that the device will fall during the process of its attachment to the column, with a resultant risk of injury to the operative or operatives.

SUMMARY OF THE INVENTION

According to one aspect of the present invention, this problem is obviated or mitigated by providing a disengageable mounting whereby the or each piston and cylinder device is carried by the support, the disengageable mounting being operative to permit one end of the device to be engaged with a respective attachment point on the column while the device is still carried by the support, the mounting also being operative to permit disengagement of the device from the support by subsequent operation of the device to lift it bodily relative to the support, whereby the device can then be swung to bring its other end into engagement with another attachment point on the column. Preferably, the support is in the form of a wheeled chassis. Advantageously, the disengageable mounting between the or each piston and cylinder device and the support is a disengageable pivotal mounting, and the or each piston and cylinder device is stored in a predetermined pivotal position relative to the support. Desirably, the support includes engagement means which releasably engages the or each piston and cylinder device (preferably at one end of the latter) to hold the device in its stored position. Conveniently, said one end of the or each piston and cylinder device includes an aperture, and the engagement means comprises a slot or opening in the support which is aligned with said aperture in the stored position of the piston and cylinder device, and a removable pin which extends through the slot/opening and the aperture. Preferably, the disengageable mounting comprises at least one slot in the support which engages a respective pivot pin on the or each piston and cylinder device. Advantageously, said at least one slot is angled so that the respective pivot pin cannot disengage therefrom when the or each piston and cylinder device is in its stored position.

According to a second aspect of the present invention, there is provided a method of attaching a piston and cylinder device to a raising and lowering column, the method comprising positioning in close proximity to the column a support on which the piston and cylinder device is carried by means of a disengageable mounting, operating the device to bring one end thereof into engagement with a first attachment point on one of the column parts, securing said one end of the device to the first attachment point, operating the device to move the latter bodily relative to the support and thereby disengage the mounting, swinging the device about the first attachment point to bring its other end into engagement with a second attachment point on the other column part, and securing said other end of the device to the second attachment point.

Preferably, the first attachment point is on the upper column part, and the piston and cylinder device is extended to bring said one end into engagement with the first attachment point and is retracted to disengage the mounting. Advantageously, the disengageable mounting between the piston and cylinder device and the support is a disengageable pivotal mounting, the device is stored in a predetermined pivotal position relative to the support, and is pivoted out of that predetermined pivotal position before being operated to bring said one end into engagement with the first attachment point.

BRIEF DESCRIPTION OF THE DRAWINGS

The invention will now be further described, by way of example only, with reference to the accompanying drawing, in which.

DESCRIPTION OF THE PREFERRED EMBODIMENT

Figure 1:
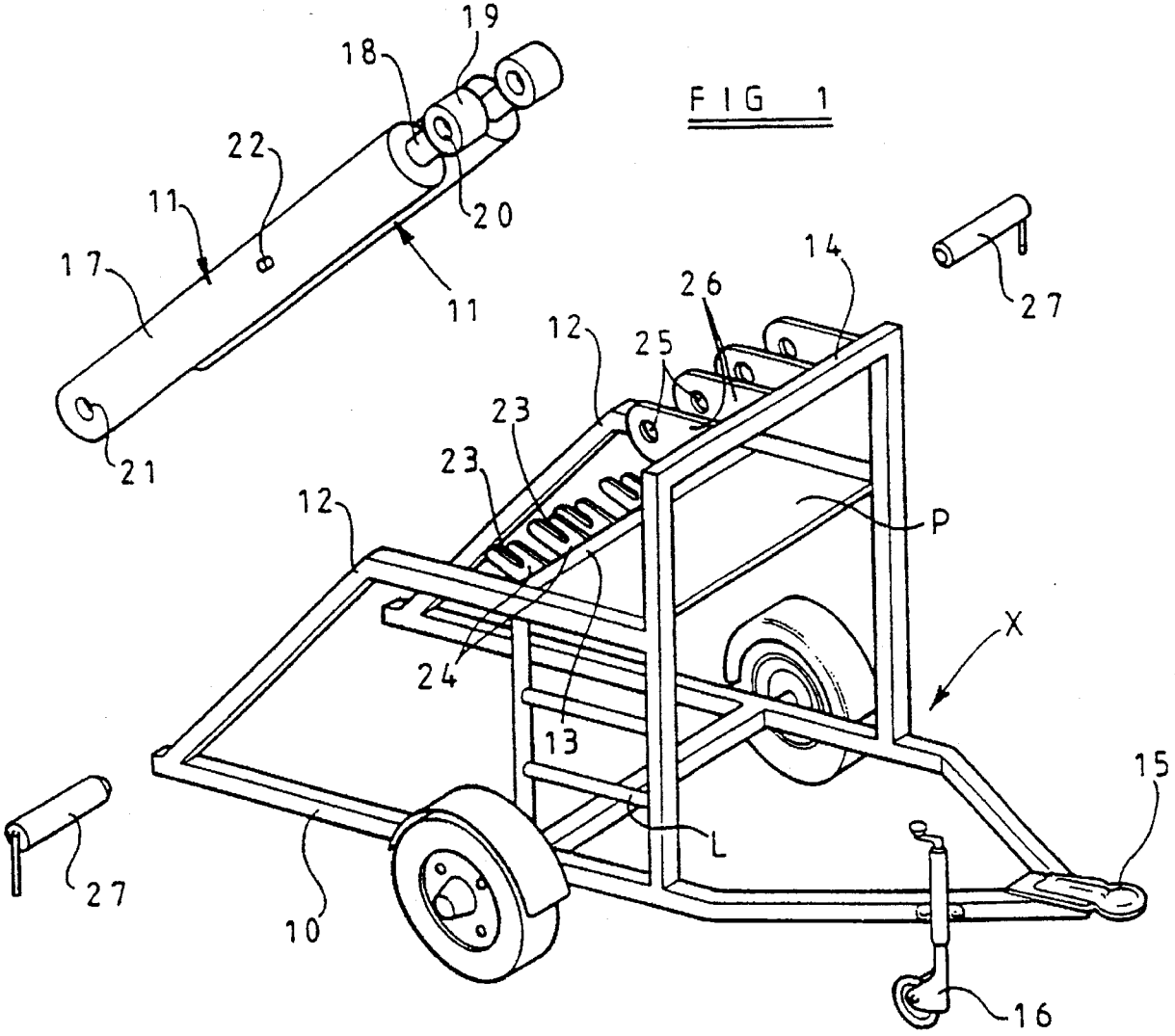
FIG. 1 is a schematic exploded perspective view of an apparatus (in the form of a counterbalance unit) for operating a raising and lowering column, according to one aspect of the present invention.

Referring first to FIG. 1, the illustrated counterbalance unit comprises a support in the form of a wheeled chassis 10 which carries a pair of hydraulic piston and cylinder devices or rams 11. The chassis 10 is composed of a pair of side frames 12 linked inter alia by cross-members 13 and 14. The chassis 10 is open at its rear, and at its forward end has a fitment 15 by which it can be towed e.g. by a motor vehicle. Also at the forward end there is provided a swivelling caster 16 which assists in maneuvering the chassis into position once it has been detached from the towing vehicle.

Each of the rams 11 comprises a relatively expandable and retractable cylinder unit 17 and piston rod 18. The piston rod 18 has at its end a boss 19 with an aperture 20 therein, while a further aperture 21 is provided in the cylinder unit 17 at the opposite end of the ram 11. The cylinder unit 17 also carries on its sides opposed pivot pins or trunnions 22 and these are pivotally and detachably received in respective slots 23 in hook-like mounting members 24 which extend rearwardly from the cross-member 13. During transportation and storage, the rams 11 occupy a predetermined pivotal position relative to the chassis 10, wherein the aperture 20 in the bosses 19 are aligned with holes 25 in members 26 which extend through each boss 19 and the slots 25 in the respective adjacent members 26. The slots 23 are angled so as to prevent the pivot pins 22 from disengaging therefrom when the rams 11 are in their stores positions, for example when the counterbalance unit is being towed over a bumpy surface.

The chassis 10 also carries the necessary hydraulic equipment for operating the rams 11, such as a reservoir for hydraulic fluid, a pump and connecting pipework. Although not specifically illustrated, this equipment is mounted on a forward end of the chassis in a space generally designated at X.

Figure 4:
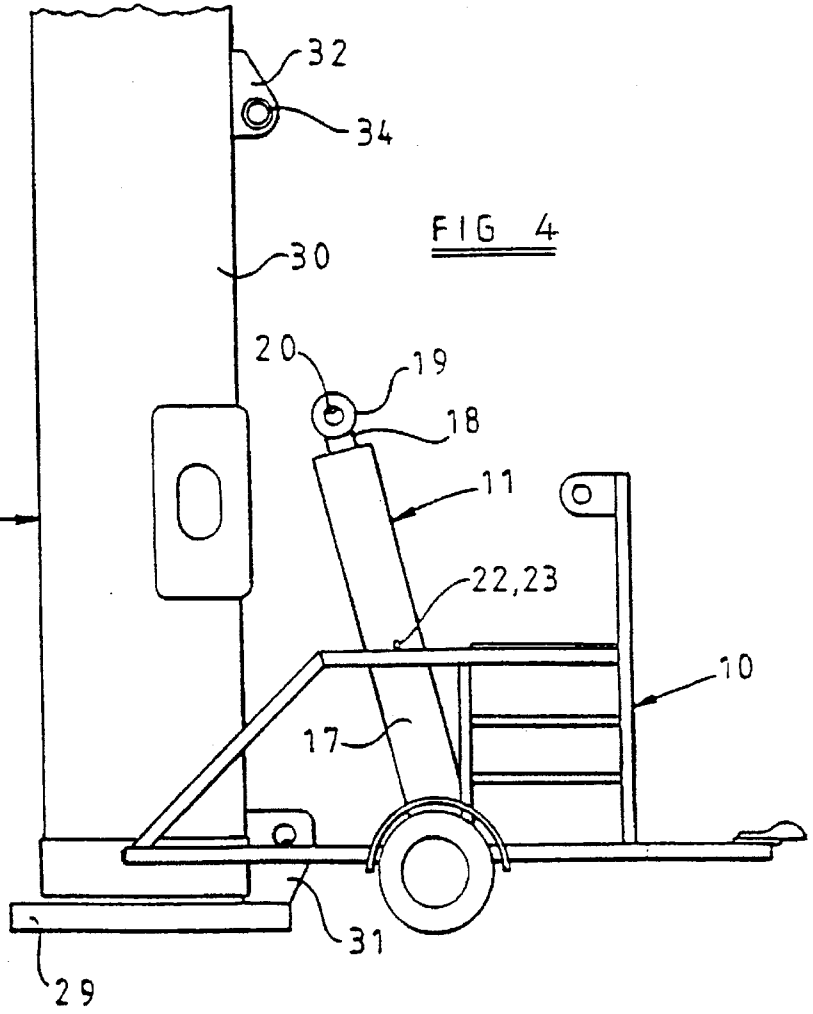
FIGS. 2 to 6 are side views showing successive steps in a method of attaching the apparatus shown in FIG. 1 to a raising and lowering column, according to another aspect of the present invention.

Referring now briefly to FIG. 4, the counterbalance unit is intended for use with a column 28 comprising a relatively fixed base part 29 and an upper part 30 which can be pivotally raised and lowered relative to the base part 29, in order to enable e.g. a lighting fitment (not shown) mounted at the top of the part 30 to be brought down to ground level for servicing and/or repair. The base part 29 has to either side thereof a pair of laterally spaced gussets 31 for receiving the cylinder unit 17 of a respective one of the rams 11, while the upper part 30 similarly has to each side thereof a pair of laterally spaced gussets 32 for engagement with the boss 19 on the piston rod 18 of the respective ram.

Figure 2:
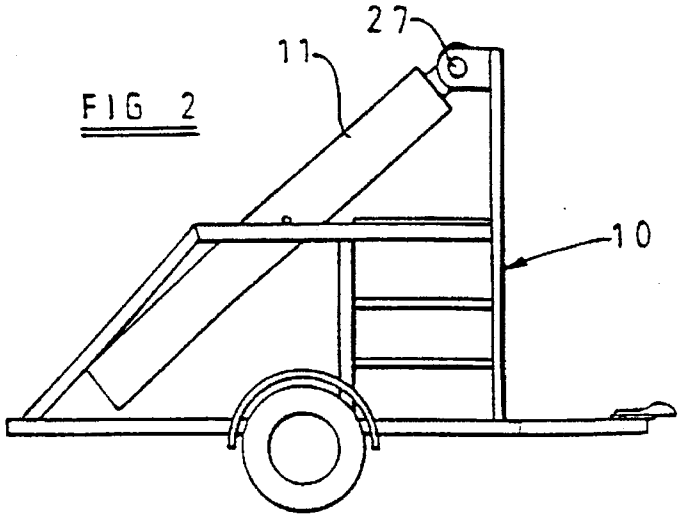
Figure 3:
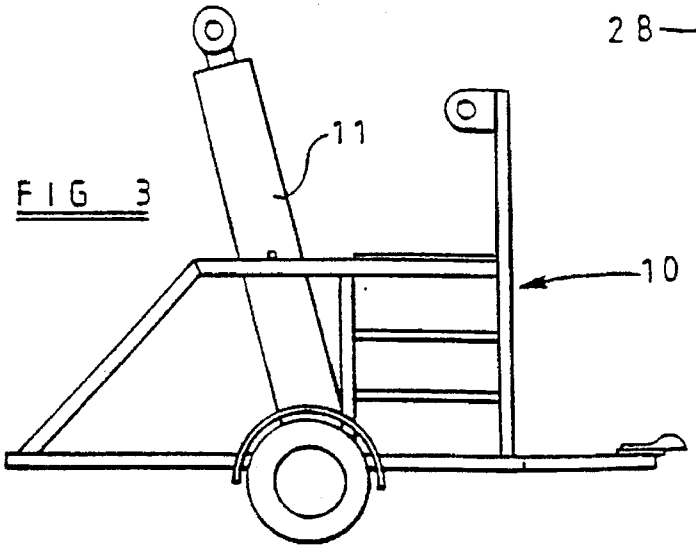

FIG. 2 shows the counterbalance unit with the rams 11 in their stored position. In order to attach the rams 11 to the column 28, the retaining pins 27 are removed and the rams 11 are pivoted relative to the chassis 10 to a position where they are slightly rearwardly inclined, as depicted in FIG. 3. The chassis 10 is the maneuvered into position so that the rear of the side frames 12 extend respectively on either side of the column 28. The counterbalance unit is then in the position illustrated in FIG. 4.

Figure 5:
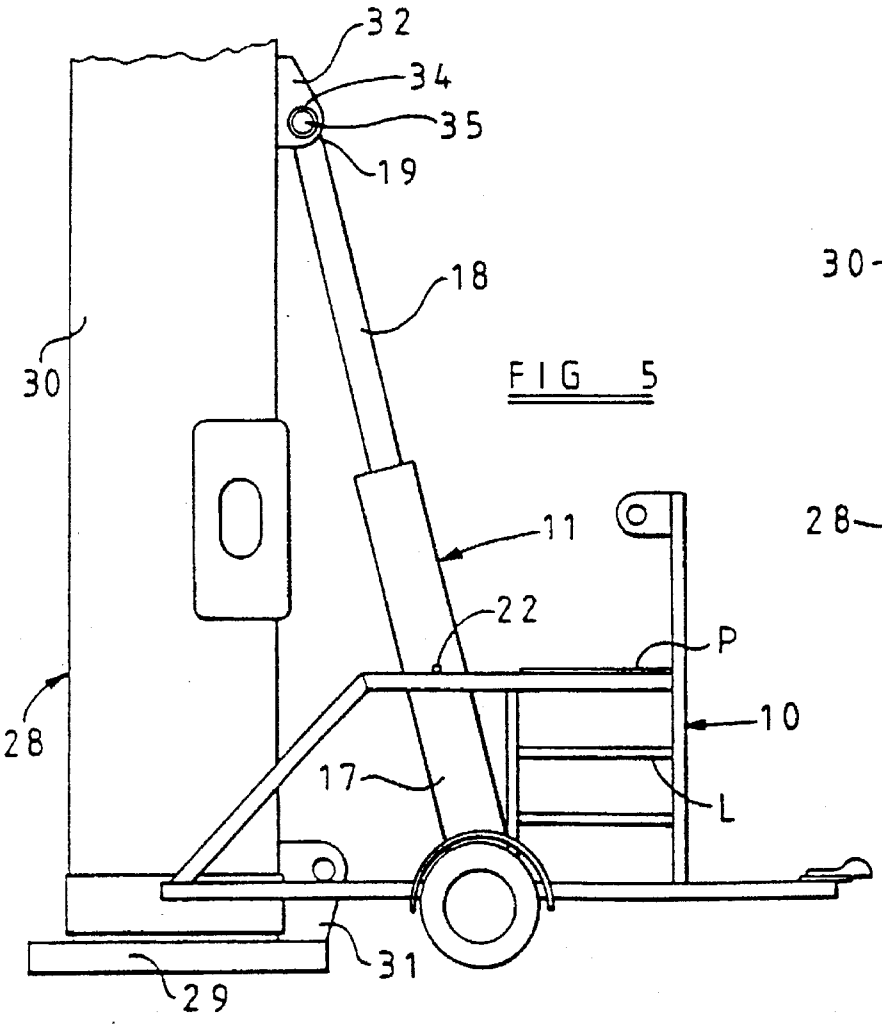

The rams 11 are then extended to bring the boss 19 on each piston rod 18 into engagement with the respective gussets 32, with the aperture 20 in the boss 19 being aligned with holes 34 in the gussets 32. The pivotal position of each ram 11 relative to the chassis 10 can be adjusted at this time to ensure proper alignment of the boss 19 and the gussets 32. A retaining pin 35 is then inserted through each aperture 20 and the associated holes 34. The counterbalance unit now occupies a position as shown in FIG. 5. To facilitate insertion of the pins 35, the counterbalance unit is provided with a platform P on which the operative can stand, access to the platform being gained by way of a ladder L on one side of the unit.

Figure 6:
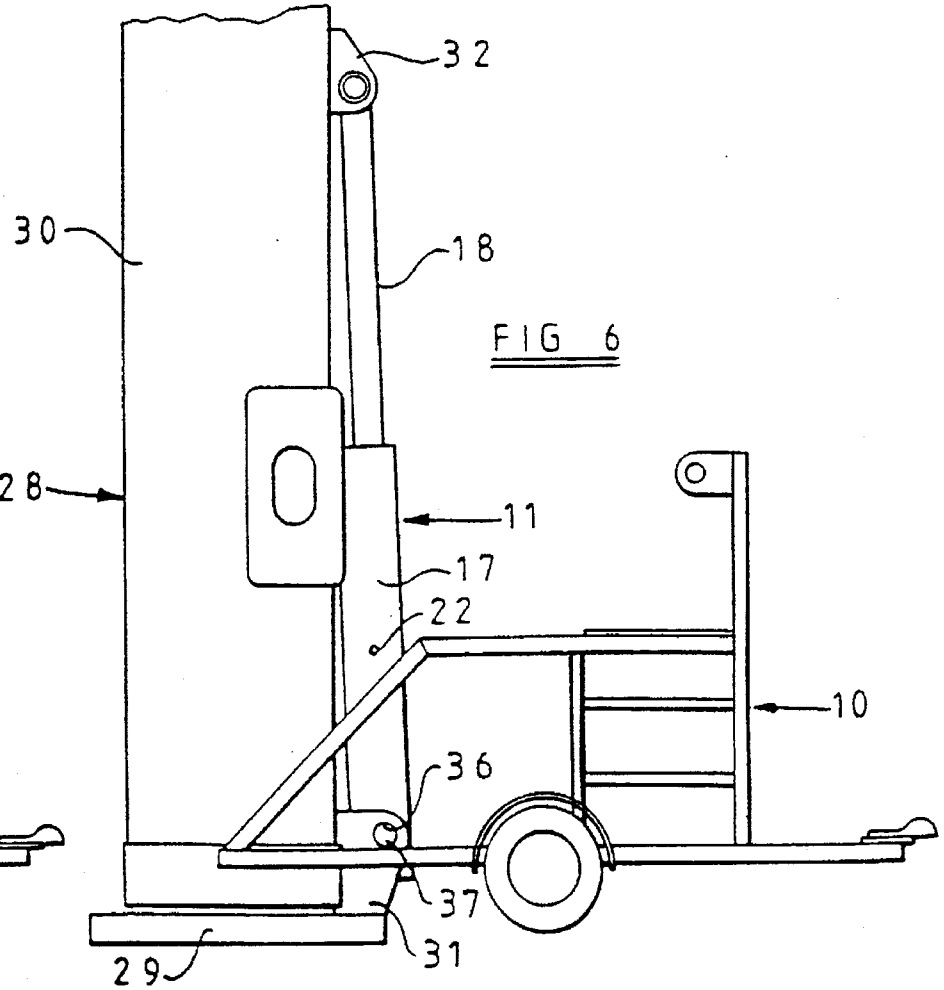

Following this, the piston rods 18 of the rams 11 are retracted slightly to lift the cylinder units 17 bodily relative to the chassis 10 and thereby raise the pivot pins 22 out of the slots 23. The forward angling of the slots 23 means that it is not necessary to swing the rams 11 during this operation to ensure that the pins 22 clear the slots 23. Once the pins 22 are clear of the slots 23, the rams 11 are swung downwardly about the respective pins 35 to bring the cylinder units 17 into engagement with the respective gussets 31 on the base part 29. The rams 11 are also extended or retracted as necessary to align the apertures 21 in the cylinder unit with holes 36 in the gussets 31. A retaining pin 37 is then inserted through each aperture 21 and the associated holes 28 (as depicted in FIG. 6) and are ready to assist in the pivotal lowering and raising of the upper column part 30 in a conventional manner. In order to remove the rams 11 from the column, the above-described sequence of operations is followed in reverse. The pins 27, 35 and 37 are arranged so as to be of the same size and design, so they can be interchanged.

Figure 7:
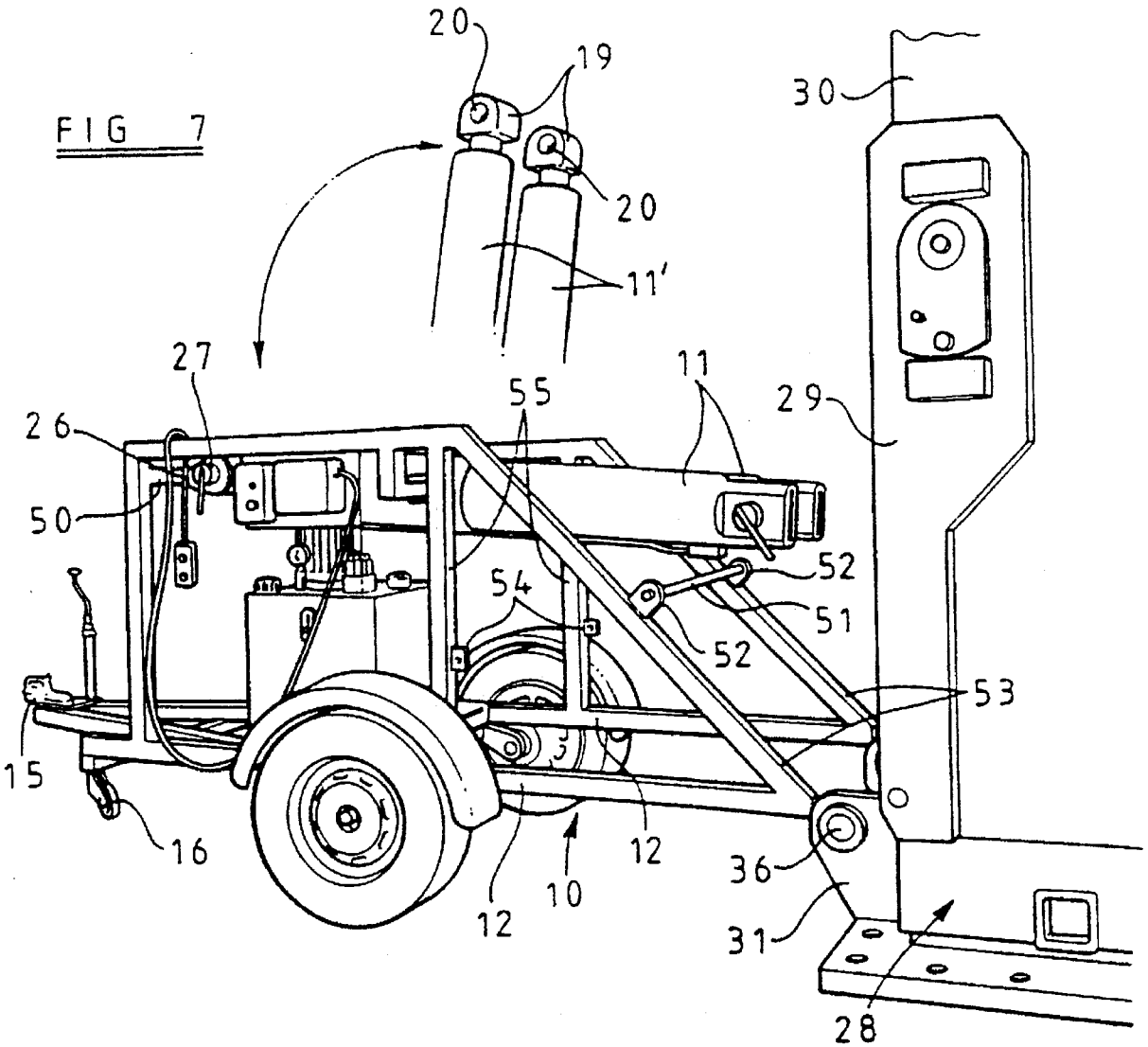
FIG. 7 is a perspective view of a modified version of the counterbalance unit.

FIG. 7 illustrates a modified version of the counterbalance unit which is intended for use with taller (and therefore heavier) columns, and in which the rams 11 are of heavier duty construction. In this unit, the members 26 extend rearwardly from a cross-member 50 which is provided at the front of the chassis 10, and the rams 11 are depicted in their transportation/storage position wherein they are near-horizontal and their bosses 19 are engaged with those members 26 by the retaining pins 27.

Operation of this version of the counterbalance unit is generally similar to that described above. In this unit, however, there is also provided a safety bar 51 which is selectively engageable with mountings 52 on sloping rear members 53 of the chassis 10 and with mountings 54 on upright intermediate members 55 of the latter. During transportation and storage, the safety bar 51 is engaged with the mountings 52 so that it is disposed below the free ends of the rams 11, to prevent the rams from accidentally rotating. Prior to operation of the unit, the safety bar 51 is removed. Once the rams 11 have been rotated into their near-vertical positions (as depicted at 11'), the safety bar 51 is re-engaged with the mounts 54, to prevent the rams 11 from rotating while they are engaged with the upper column part 30. Once such engagement has been achieved, the bar 51 is removed once again to allow the rams 11 to be lifted from their mountings and swung into engagement with the column base part 29. The safety bar 51 is used in an analogous manner during de-mounting of the rams 11 from the column.

The counterbalance units described above are particularly (though not exclusively) applicable for use with columns which are 35 meters or higher, where the rams must be fairly robust in order to support the weight of the upper column part during its raising and lowering. This in turn means that the rams themselves are fairly heavy, and would present considerable hazards to operatives attempting to attach them to the column by purely manual means. By utilizing the above-described counterbalance unit and method of attaching the rams 11 to the column, the whole operation can be conduced safely with no danger of the operative suffering muscular strains through manual manipulation of the rams into position, or becoming injured due to the rams accidentally being dropped. Although the counterbalance units have been described as containing two rams, they can alternatively have just one.

I claim:

1. An apparatus for operating a raising and lowering column, wherein at least one piston and cylinder device is carried by a support and wherein opposite ends of the device are adapted for detachable engagement with respective attachment points on the column, characterized in that the at least one piston and cylinder device is carried on the support by a disengageable mounting operative to permit one end of the device to be engaged with the respective attachment point while the device is still carried by the support, and the mounting also being operative to permit disengagement of the device from the support by subsequent operation of the device for moving the device relative to the support, wherein the device can be swung to bring its other end into engagement with the other attachment point for concurrent attachment to the column.

2. The apparatus as claimed in claim 1, wherein the support is a wheeled chassis.

3. The apparatus as claimed in claim 1, wherein the disengageable mounting between the at least one piston and cylinder device and the support is a disengageable pivotal mounting, and the at least one piston and cylinder device is stored in a predetermined pivotal position relative to the support.

4. The apparatus as claimed in claim 3, wherein the support includes engagement means which releasably engages the at least one piston and cylinder device to hold the cylinder device in a stored position.

5. An apparatus for operating a raising and lowering column, wherein at least one piston and cylinder device is carried by a support and wherein opposite ends of the device are adapted for detachable engagement with respective attachment points on the column, characterized in that the at least one piston and cylinder device is carried on the support by a disengagable mounting operative to permit one end of the device to be engaged with the respective attachment point while the device is still carried by the support, and the mounting also being operative to permit disengagement of the device from the support by subsequent operation of the device for moving the device relative to the support, whereby the device can be swung to bring its other end into engagement with the other attachment point, wherein the disengageable mounting between the at least one piston and cylinder device and the support is a disengageable pivotal mounting and the at least one piston and cylinder device is stored in a predetermined pivotal position relative to the support, wherein the support includes engagement means which releasably engages the at least one piston and cylinder device to hold the cylinder device in a stored position, wherein the engagement means releasably engages the at least one piston and cylinder device at one end of the cylinder device.

6. An apparatus for operating a raising and lowering column, wherein at least one piston and cylinder device is carried by a support and wherein opposite ends of the device are adapted for detachable engagement with respective attachment points on the column, characterized in that the at least one piston and cylinder device is carried on the support by way of a disengagable mounting operative to permit one end of the device to be engaged with the respective attachment point while the device is still carried by the support, and the mounting also being operative to permit disengagement of the device from the support by subsequent operation of the device for moving the device relative to the support, whereby the device can be swung to bring its other end into engagement with the other attachment point, wherein the disengageable mounting between the at least one piston and cylinder device and the support is a disengageable pivotal mounting and the at least one piston and cylinder device is stored in a predetermined pivotal position relative to the support, wherein the support includes engagement means which releasably engages the at least one piston and cylinder device to hold the cylinder device in a stored position, wherein said one end of the at least one piston and cylinder device includes an aperture, and the engagement means includes a slot in the support which is aligned with said aperture in the stored position of the piston and cylinder device, and a removable pin which extends through the slot and the aperture.

7. An apparatus for operating a raising and lowering column, wherein at least one piston and cylinder device is carried by a support and wherein the opposite ends of the device are adapted for detachable engagement with respective attachment points on the column, characterized in that the at least one piston and cylinder device is carried on the support by disengagable mounting operative to permit one end of the device to be engaged with the respective attachment point while the device is still carried by the support, and the mounting also being operative to permit disengagement of the device from the support by subsequent operation of the device for moving the device relative to the support, whereby the device can be swung to bring its other end into engagement with the other attachment point, wherein the disengageable mounting comprises at least one slot in the support which engages a respective pivot pin on the at least one piston and cylinder device.

8. The apparatus as claimed in claim 7, wherein said at least one slot is angled so that the respective pivot pin cannot disengage therefrom when the at least one piston and cylinder device is in a stored position.

9. A method of attaching a piston and cylinder device to a raising and lowering column, wherein a support carrying the piston and cylinder device is placed in close proximity to the column, and wherein opposite ends of the device are successively engaged with and secured to respective attachment points on the column, comprising the steps of: carrying the piston and cylinder device on the support by way of a disengageable mounting; operating the device to move said device relative to the support after securing one end of the device to its respective attachment point, operating the device to move it relative to the support and thereby disengaging the mounting; swinging the device about the said attachment point to bring its other end into engagement with the other attachment point; and securing said other end of the device to said other attachment point.

10. A method as claimed in claim 9 further including the steps of: extending the piston and cylinder device to bring said one end into engagement with the first attachment point, wherein the first attachment point is on an upper part of the column, and retracting the piston and cylinder device to disengage the mounting.

11. A method as claimed in claim 9 further including steps of: storing the device in a predetermined pivotal position relative to the support, and pivoting out the device from that predetermined pivotal position before operating the device to bring said one end into engagement with the first attachment point wherein the disengageable mounting between the piston and cylinder device and the support is a disengageable pivotal mounting.

* * * * *